United States Patent [19]

Johnson

[11] Patent Number: 4,745,655

[45] Date of Patent: May 24, 1988

[54] AIR-POWERED VACUUM-PRODUCING APPARATUS

[76] Inventor: Emil R. Johnson, 375 Sumpter Rd., Belleville, Mich. 48111

[21] Appl. No.: 27,577

[22] Filed: Mar. 18, 1987

[51] Int. Cl.[4] ..... A47L 5/18

[52] U.S. Cl. ..... 15/409; 15/323

[58] Field of Search ..... 15/409, 323, 406

[56] References Cited

U.S. PATENT DOCUMENTS

| | | | |
|---|---|---|---|
| 1,985,157 | 12/1934 | Friedman et al. | 15/409 |
| 2,332,208 | 10/1943 | Dow | 15/323 |
| 2,603,817 | 7/1952 | Anthony | 15/406 X |
| 3,964,123 | 6/1976 | Pettersson | 15/409 X |

FOREIGN PATENT DOCUMENTS

| | | | |
|---|---|---|---|
| 403503 | 9/1924 | Fed. Rep. of Germany | 15/409 |
| 843511 | 3/1939 | France | 15/409 |
| 1008677 | 11/1965 | United Kingdom | 15/409 |

*Primary Examiner*—Chris K. Moore

*Attorney, Agent, or Firm*—Cullen, Sloman, Cantor, Grauer, Scott & Rutherford

[57] ABSTRACT

An air-powered vacuum-producing apparatus or vacuum tool is disclosed which may be utilized in combination with a discharge collection assembly to pick up and collect debris, dust and liquids. The apparatus may be powered by any suitable, relatively high pressure gaseous medium such as compressed air. The apparatus includes a body having an elongated central chamber and a high pressure inlet, a suction inlet and a discharge outlet in communication with the chamber. The high pressure inlet is located downstream of the suction inlet and injects pressurized gaseous fluid into the chamber so as to more efficiently create a reduced pressure area or vacuum adjacent to the suction inlet. The body may be provided with first and second interconnected body portions respectively having first and second interconnected chamber portions. Conduit means, such as an extension pipe, may be used to allow the high pressure fluid to come through an upstream endwall in the first body portion, and pass through the first chamber portion into the second chamber portion so as to place the high pressure inlet at the distal end of the pipe in the second chamber portion. The discharge collection assembly includes a collection container or drum in communication with the discharge outlet of the vacuum tool by a flexible discharge hose which may be substantially larger in diameter than the discharge outlet and up to 50 or more feet in length. The collection container may be provided with a cover having an opening therein over which a filter bag assembly is located to allow discharged gaseous fluid to be exhausted to the atmosphere while simultaneously preventing dust and other debris which has been collected from being exhausted.

1 Claim, 2 Drawing Sheets

AIR-POWERED VACUUM-PRODUCING APPARATUS

FIELD OF THE INVENTION

The present invention relates in general to vacuum-producing equipment for picking up and collecting debris, dust, liquids, and the like, and relates in particular to vacuum-producing tools and apparatus which are powered by a pressurized gaseous fluid, such as compressed air, which is passed through a chamber at a speed sufficient to create a vacuum at a suction inlet of the chamber.

BACKGROUND OF THE INVENTION

Various vacuum-producing tools and apparatus powered by an electric motor and designed for picking up debris, dust and liquids are well-known and in common use. One class of such devices is the wet-dry shop vacuum which includes an electric motor which turns a fan disposed within a blower cage in order to create a partial vacuum within a tank to provide suction. Such shop vacuums often have a filter disposed in the tank in front of the blower cage to prevent the blower cage from becoming clogged and to prevent matter which is picked up by the device from being exhausted out of the discharge outlet of the device. There are several disadvantages associated with such shop vacuums and other vacuum units or systems powered by electric motors, which become especially apparent in certain heavy-duty or severe use applications. Examples of such disadvantages include the electric cord for the vacuum unit becoming frayed or broken, and the filter becoming clogged with debris or dust which has been vacuumed up. Moreover, fine powdery substances thus cannot be picked up in any quantity without clogging the filter. The capacity and speed with which shop vacuums pick up liquids is also limited. After liquids are picked up, the typical filter must be allowed to dry before dirt and dust can be picked up or else the filter will quickly become clogged. Also, the ability to pick up combustible materials is limited if the electric motor used in the shop vacuum is sufficiently open to allow sparks generated by the operation of the motor to possibly ignite the materials or airborne particulate or vapors associated therewith. In addition, shop vacuums often create very loud noises during operation, which can be quite bothersome for a number of reasons. Further, the electric motor after some limited period of time will burn out or wear out, thus requiring repair or replacement. This process is often accelerated when contaminants (that is the collected airborne debris, dust or liquids) make their way into the motor housing. This is particularly costly for when the motor is a large electric motor powering a large central vacuum system utilizing duct work or the like to interconnect multiple vacuum stations used by a several workers.

As an alternative, a number of air-powered vacuum-producing apparatus are known which do not suffer from most of the foregoing disadvantages. For example, air-operated vacuuming tools or devices have been utilized for such tasks as removing water and other debris from weather-exposed truck tires which are to be recapped. Typically, the liquids and debris so picked up are collected in a pail or other container. Such devices have the advantage of not requiring any electricity to operate. However, they require a tremendous amount of pressurized air to operate relative to the amount of liquid or debris which they pick up. This makes them objectionably noisy and quite inefficient from an energy standpoint. Also, the capacity (i.e., volume of air sucked up per unit time) and suction power (i.e., the degree of vacuum) of such prior art devices are limited, thus rendering such air-powered vacuuming devices insufficient for a number of applications, particularly where the objects or matter to be picked up are relatively large or heavy.

The object of the present invention is to overcome the foregoing disadvantages and limitations associated with conventional vacuum units and systems powered by electric motors and with conventional air-powered vacuum-producing tools and devices.

SUMMARY OF THE INVENTION

In contrast to the vacuum-producing units and devices described above, the vacuum-producing apparatus of the present invention can vacuum up matter such as dirt, dust, twigs and leaves, liquids, and heavier matter, such as plastic, rubber or metal filings, chips and shavings, broken pieces of shatter-resistant glass, small masonry pieces and stones, and the like, by creating sufficient suction while utilizing compressed air at a limited rate, and producing significantly less noise than conventional air-powered tools and devices and most vacuum units powered by an electric motor.

To achieve the foregoing object and results, there is provided according to one aspect of the present invention an improved vacuum-producing apparatus of the type powered by a stream of pressurized gaseous fluid and including a body having a chamber, a first inlet for allowing the stream of pressurized fluid to flow into the chamber, a discharge outlet for allowing the fluid to flow out of the chamber, and a second or suction inlet in fluid communication with the chamber and arranged with respect to the first inlet and the outlet to enable a vacuum to be produced at the second outlet when the stream of pressurized fluid is flowing in the chamber. The improvement in the vacuum-producing apparatus comprises in combination: the second inlet being located relative to the first inlet and the outlet such that when the stream of pressurized fluid flows into the chamber, the stream is flowing generally away from the second inlet. Typically, the body will have first and second connected body portions which respectively have first and second interconnected chamber portions which form the chamber. The first body portion includes the second inlet and the second body portion includes the discharge outlet, and the first inlet opens, not into the first chamber portion, but instead into the second chamber portion. The second body portion is preferably elongated and has a relatively smooth interior surface which defines the second chamber portion. The second chamber portion is correspondingly elongated and has an average width and an average length, wherein the average length is at least several times greater than the average width, and may be at least about ten times, twenty times or more greater than the average width. In this regard, it is preferred to make the length sufficiently large relative to the width to provide substantially laminar flow of the pressurized fluid through at least a part of the second chamber portion, thereby allowing a better powerful vacuum to be produced at the second inlet.

In a preferred embodiment of this aspect of the invention, the first and second chamber portions are arranged along a common longitudinal axis and are preferably substantially cylindrical. In this embodiment, the second chamber portion has an average length which is preferably at least about ten times its average diameter. The apparatus also preferably includes conduit means, disposed at least partially within the chamber, for providing the pressurized fluid to the first inlet. The conduit means has an end portion within the chamber which is provided with at least one opening that constitutes at least part of the first inlet and may constitute all of the first inlet. The first body portion may have a wall portion from which the conduit means extends into and through the first chamber portion, so as to reach the second chamber portion. The first body portion may include an opening and a bushing sealingly engaged in the opening. The bushing may have a passage therethrough which forms part of the conduit means. The conduit means preferably includes an elongated hollow member such as a small pipe or tube having an average inner diameter which is at least preferably five times smaller in area than the average size of the chamber. This hollow member is preferably supported at one end thereof by the bushing, extends outwardly from the bushing, and terminates or ends in the second chamber portion.

In this preferred embodiment of the present invention, the first inlet preferably has a size which is at least about five times smaller in area than the average cross-sectional area of the chamber transverse to the direction of flow of pressurized fluid through the chamber. The area of the first inlet may also be 10 or even 100 times smaller than the cross-sectional area of the chamber, depending at least in part on the operating pressure of the pressurized fluid.

The apparatus of the present invention may further include: (1) valve means connected to the first inlet for controlling the flow of pressurized fluid into the first inlet; (2) mounting means for supporting the apparatus at an elevation convenient for manually operating the valve means; and (3) discharge conduit means connected to the discharge outlet for receiving gaseous fluid and any matter discharged therefrom, and directing the fluid and matter to a location remote from the discharged outlet. The discharge conduit means typically will have a passage longitudinally extending therethrough whose average cross-sectional area transverse to the direction of the fluid flow is substantially larger, such as two or three times or more larger than the size of the discharge outlet. Also, the passage is preferably sufficiently long to reduce significantly the speed of fluid flowing therethrough. In both embodiments, the apparatus may further include discharge collection means in fluid communication with the discharge conduit means for receiving and holding matter discharged from the outlet through the discharge conduit means.

These and other aspects, objects, advantages and features of the present invention will be described in detail below in conjunction with the accompanying drawings and appended claims.

DETAILED DESCRIPTION OF THE PREFERRED EMBODIMENTS

Figure 1:
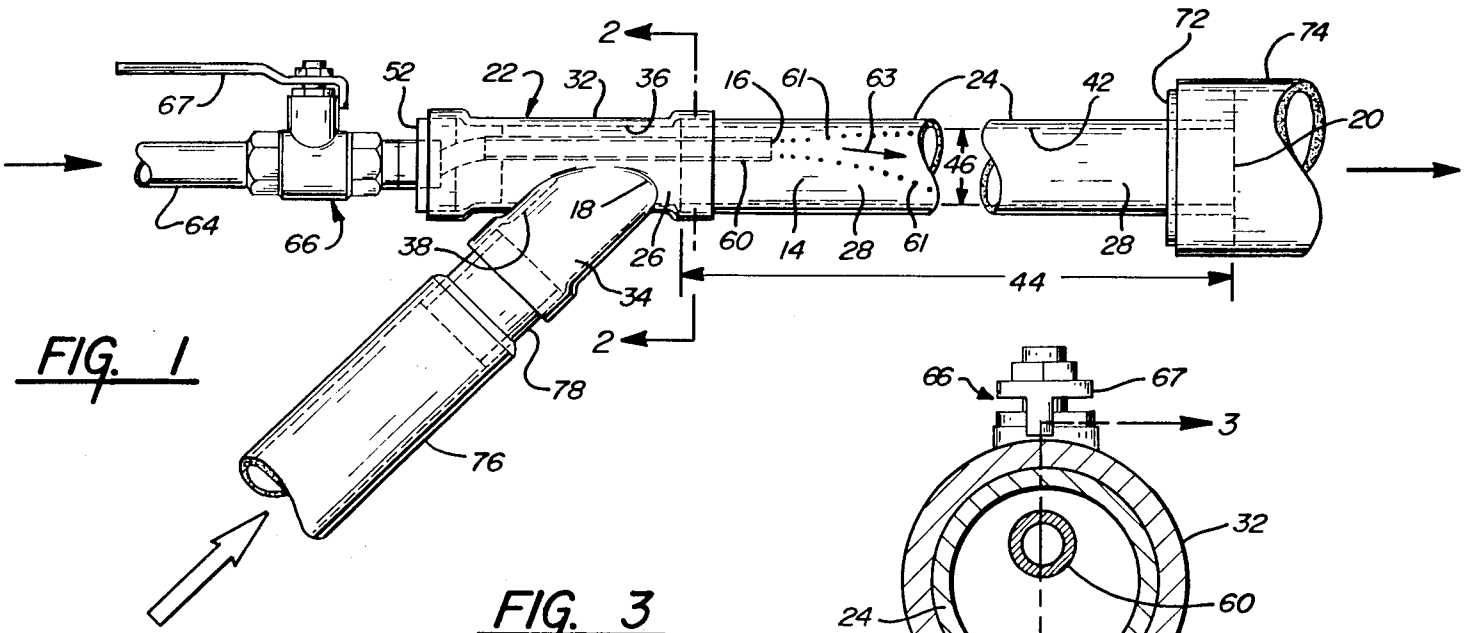
FIG. 1 is a side elevational view of a preferred embodiment of the air-operated vacuum-producing apparatus of the present invention without a discharge collection assembly.

Referring to FIG. 1, an air-powered vacuum-producing apparatus 10 of the present invention is illustrated. The vacuum-producing apparatus 10, which may for convenience sometimes be referred to as a vacuum tool 10, includes a body 12 having an elongated central vacuum-producing chamber 14 therein. The body 12 may be made of plastic, metal or any other substantially rigid material suitable for the particular application for which the tool 10 will be used. The chamber 14 is substantially closed and has two inlets and one outlet. A first inlet 16 allows pressurized gaseous fluid such as compressed air to flow into the chamber 14. The vacuum tool 10 has a second inlet 18 in fluid communication with the chamber 14 and arranged with respect to the first inlet 16 to enable a vacuum or suction to be produced at the suction inlet 18 when a stream of pressurized fluid is flowing into the chamber 14. The tool 10 also has a discharge outlet 20 in communication with the chamber 14 for allowing the pressurized fluid to flow out of the chamber 14. The main body 12 may be constructed of first and second connected body portions 22 and 24 which respectively have first and second interconnected chamber portions 26 and 28. Together the chamber portions 26 and 28 form substantially all of the main chamber 14.

Figure 2:
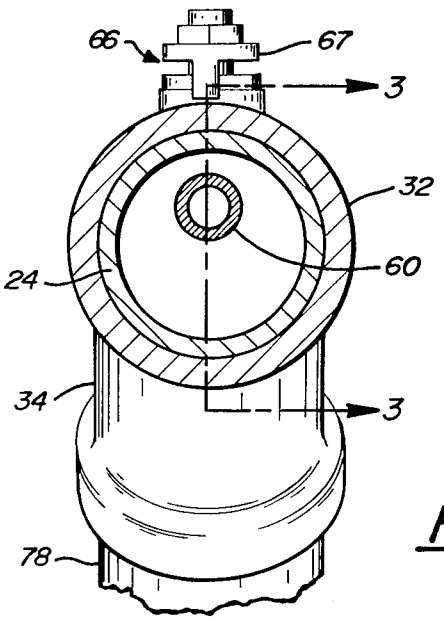
FIG. 2 is a cross-sectional view of the FIG. 1 apparatus taken along line 2—2 of FIG. 1.

As shown in FIGS. 1 and 2, the first body portion 22 has a Y-shaped configuration comprised of first and second interconnected hollow cylindrical segments 32 and 34 arranged at an angle such as 45°. The cylindrical segments 32 and 34 each have substantially cylindrical bores 36 and 38 which intersect one another and form the first chamber portion 26. The end of second bore 38 closest to first chamber portion 26 constitutes the second or suction inlet 18. The second body portion 24 is preferably an elongated cylinder having a substantially cylindrical bore 42 which has an average length 44 at least several times greater than its average width or diameter 46. The bore 42 constitutes the second chamber portion 28, and preferably has a relatively smooth interior surface. As shown in FIG. 1, the first and second chamber portions 26 and 28 comprised of the bore 36 and bore 42 are preferably arranged along a common longitudinal axis. The average length 44 is preferably at least ten times greater than the average width 46. I have found that for the exemplary operating pressures set forth below, a length of at least about twenty times greater than the width produces optimal results. When the average length 44 is sufficiently large relative to the average width 46, the efficiency of operation of the tool 10 is greatly increased. I believe that a sufficient length 44 relative to the width 46 results in a substantially laminar flow of the pressurized fluid from the inlet 16 through at least part of the second chamber 28, thereby allowing a better vacuum to be produced at the suction inlet 18.

Figure 3:
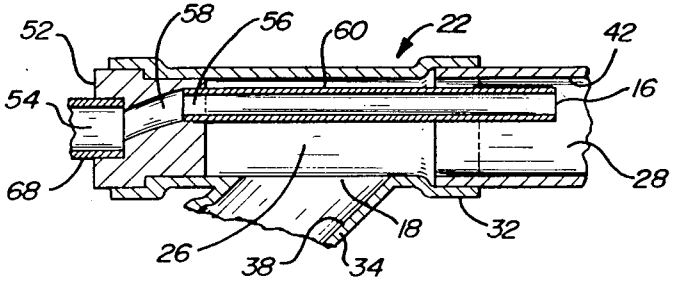
FIG. 3 is an enlarged cross-sectional view of a portion of the FIG. 1 apparatus taken along line 3—3 of the FIG. 2.

The cylindrical bore 36 of first body portion 22 has an opening at the end thereof opposite the high pressure inlet 16 which is closed or tightly sealed around its periphery by a bushing 52 which remains in place when the tool 10 is operated. As best shown in FIG. 3, the bushing 52 has a large port 54 and a small port 56 in fluid communication with one another on account of drilled passageway 58 extending between the two ports. The bushing may be made of plastic, metal or any other relatively rigid material suitable for the intended application.

In the preferred embodiment shown in FIGS. 1-3, a small conduit such as extension pipe 60 is connected to the small port 56 of the bushing 52 to introduce the pressurized fluid into the chamber 14 downstream of the suction inlet 18 so that a negative pressure area or vacuum is efficiently created adjacent to the suction inlet 18 in first chamber portion 26. As can be seen best in FIG. 1, this allows the stream of pressurized fluid, represented by dotted lines 61, to flow into or enter the chamber 14 while moving generally away from the second inlet 18 in the general direction indicated by arrow 63. It has been found that by having the extension pipe 60 extend downstream of the suction inlet 18, the efficiency of the vacuum-powered action of the apparatus 10 is significantly increased. As can be best seen in FIG. 2, the small port 56 of the bushing 52 is offset from the longitudinal axis of the bores 36 and 42 to provide additional clearance at the suction inlet 18 so that matter being picked up through the inlet will have a larger pathway to the second chamber portion 28, and be less likely lodged against pipe 30 so as to clog the suction inlet 18 or first chamber portion 26.

The pressurized fluid, which may be compressed air or any other suitable gaseous medium, is provided to the vacuum tool 10 via a conduit such as a pipe 64. A shut-off valve, such as gate valve 66 having a rotatable handle 67, may be connected to the large port 58 of the bushing 22 by a suitable connector such as short threaded nipple 68. The shut-off valve 32 allows a user to manually turn the vacuum tool on and off in a quick, easy manner.

A second bushing 72 is located at the distal end of the second body portion 24 adjacent to and sealingly surrounding the periphery of the discharge outlet 20. The second bushing 72 provides an easy means for connecting to the outlet 20 a discharge conduit 74 which receives the pressurized fluid and any matter included therein and delivers it to a remote location. The conduit 74, which may be a flexible hose for example, is significantly larger in width or diameter than the second body portion 24. The larger diameter of conduit 74 allows the pressurized gaseous fluid flowing through second chamber portion 28 to greatly expand, thus reducing the back pressure and velocity of the discharged fluid relative to its pressure and movement within the second chamber portion as will be further explained shortly.

Another conduit 76, which may also be a flexible hose, may be connected to the cylindrical segment 34 of the first body portion 22 in order to enable the vacuum produced at the suction inlet 18 to produce a vacuum at a location remote from the main body 12 and chamber 14. By using a flexible conduit 76, the remotely produced vacuum can be readily directed into where needed in order to pick up matter such as debris, in most places where they may be found. The hose 76 may be connected to the cylindrical segment 34 of the vacuum tool by a conventional hollow fitting or adapter 78.

Figure 4:
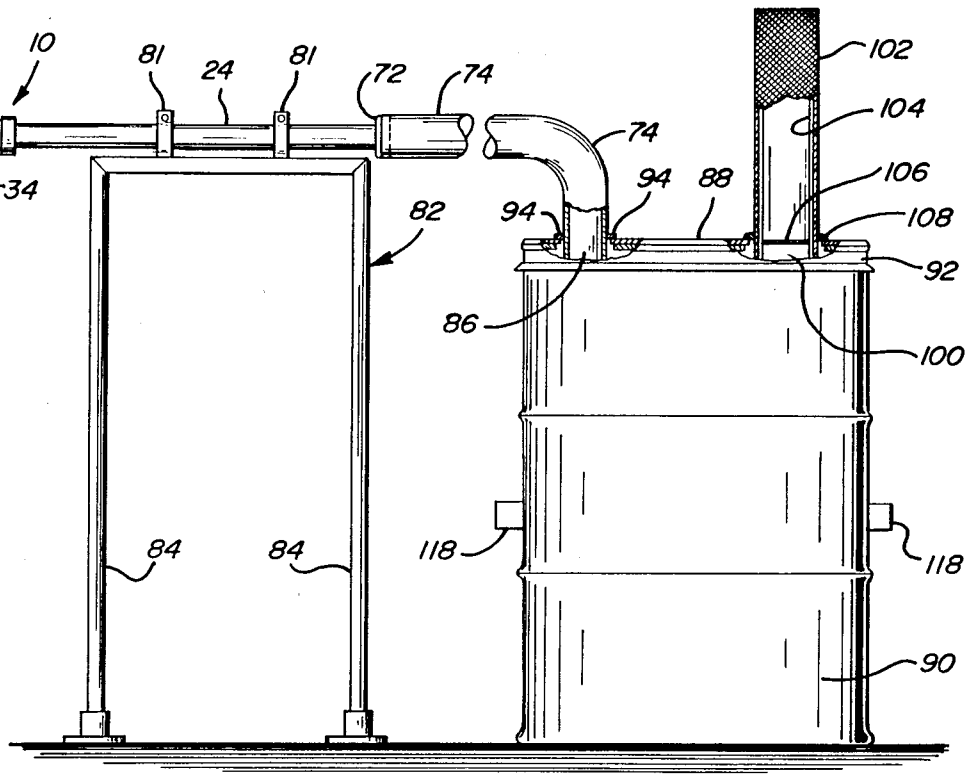
FIG. 4 is a reduced-size, side elevational view of the FIG. 1 apparatus with a discharge collection assembly for collecting matter vacuumed up with the apparatus.

As illustrated in FIG. 4, a discharge collection assembly, generally designated 80, may be used in combination with a vacuum tool 10 of the present invention to collect matter picked up and discharged by the vacuum tool. In the FIG. 4 embodiment, the tool 10 is supported by a pair of releasable brackets 81 which encircle and clamp the second body portion 24 and which form part of a mounting means such as frame 82 which preferably has at least two support columns or legs 84. The mounting means supports the vacuum-producing apparatus 10 at an elevation convenient for manually operating the valve means 66. The discharge conduit means shown in FIG. 3, namely the hose 74, directs the discharged gaseous fluid and matter from the vacuum tool 10 through an opening 86 formed in a cover or top 88 of a collection container such as drum 60. (FIG. 4 is partially broken away at the two openings in the cover 88 for the sake of clarity.) Drum 60 may be any suitable or convenient size such as the standard 55 gallon drum size used in many industries. The cover 88 and drum 90 include a flange and lip arrangement so that the cover 88 may be secured to the drum 90 by a clamp 92 fastened about the lip of the cover in any conventional or suitable manner. A gasket 94, which may be of rubber or any other suitable resilient material appropriately non-reactive with the materials to be handled, may be optionally provided along the periphery of the opening 86 to ensure the cover fits tightly upon the drum so that unfiltered gaseous fluid (which may contain dust and the like) does not leak out around the flange of the drum during use.

To prevent a build-up of pressure within the collection container 90 during operation (which would eventually lead to the inoperability of the vacuum tool 10), a suitably large opening 100 is provided in the cover 88 of the drum 90 to exhaust the gaseous fluid discharged into the drum to the atmosphere. To prevent the discharge of dust and other debris such as fine dirt and the like into the atmosphere while the gaseous fluid is being exhausted, a filter bag 102 may be placed about the opening 100. The bag 102 may be a foot or more high and several inches or more in diameter to provide increased surface area for greater capacity. A fine mesh screen and frame assembly 104, which generally conforms to the contours of the filter bag 102, is preferably used to support the bag above the opening. In addition, a coarse screen 106 may be disposed across the opening 70 to filter out relatively coarse matter that may be carried by the exhausting gaseous fluid in order to prevent the fine mesh screen of assembly 104 and/or filter bag 102 from becoming damaged or plugging prematurely. A gasket 108 is provided at the opening 100 to seal the opening against unintended leaks.

The discharge conduit 74 may be and preferably is quite long in comparison to the length 44 of the second body portion 24 in order to provide an expansion chamber to assist in slowing down the velocity of air being discharged from the discharge outlet 20. When the length of the hose 74 is sufficiently long, the velocity of the discharge fluid reaching the drum 90 will typically be slow enough to prevent the stirring up of debris, liquids, and even fine particulates such as dust, which may have accumulated at the bottom of the drum 90. The flexible hose 74 may also be up to 50 or 60 feet long. At such long lengths, the hose 74 also provides an additional volume in which the pressurized fluid may expand, in addition to the container 90, so that even when the filter bag is partially plugged, the vacuum tool can be operated for several minutes before a pressure build-up in the drum significantly affects in an adverse manner the performance of the vacuum tool 10. Thus, a sufficiently large discharge conduit assists in consuming the volume of air to eliminate such a pressure build-up while still allowing discharge matter to be reliably delivered to the collection container 90 for several minutes of operation, even with a partially blocked filter bag 102.

Figure 5:
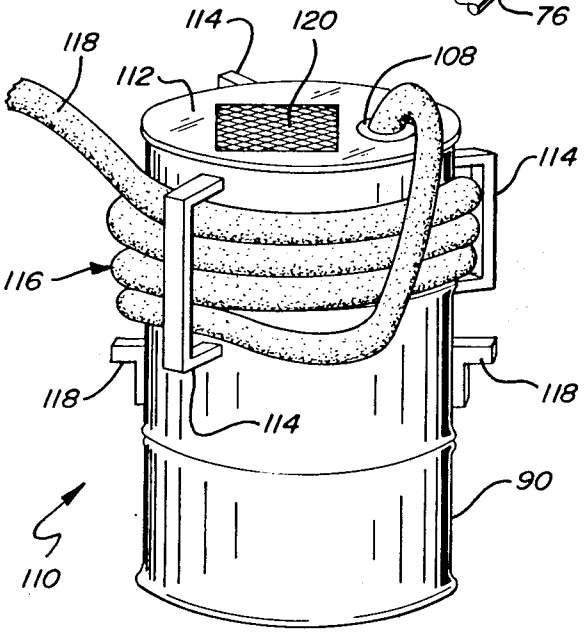
FIG. 5 is a perspective view of an alternative discharge collection assembly of the present invention.

FIG. 5 shows an alternative discharge collection assembly 110 which provides a convenient arrangement for mounting long lengths of discharge conduit. The collection assembly 110 includes a collection container 90 having a removable cover 112, which may be releasably secured to the drum 90 using any convenient technique such as the flange and lip arrangement described with respect to the FIG. 4 embodiment. The assembly 110 includes a plurality of brackets 114, such as the three brackets shown, substantially equiangularly spaced about the outer surface of the drum 90 in sufficient number, to support a discharge conduit or hose 116 coiled about the drum 90 a plurality of times (such as the three times shown). The beginning 118 of the hose 116 is connected to the discharge outlet 20 of the vacuum tool 10. The mounting brackets 114 may have an elongated C-shape as shown, so that helically arranged coils of conduit 116 can pass in the open space between the surface of the drum and each mounting bracket 114. A plurality of lifting lugs 118 may be attached to the middle portion of the drum 90 to permit the drum to be carried by a forklift truck or the like when it is to be emptied or transported.

The cover 112 is provided with a planar filter assembly 120, which as shown in FIG. 4 may be rectangular, or may be of any other suitable geometric configuration. The breathing portion of the filter assembly 120 preferably occupies a significant portion of the total area 120 of the cover 112 in order to reduce back-pressure build-up in the drum 90 as much as possible. The filter assembly 120 may include a coarse screen, a fine mesh screen, and a layer of foraminous material for finely filtering the air exhausted from the drum 90. Protective top grill work, such as an expanded metal screen as shown, may also be used if desired.

The vacuum-producing apparatus 10 and the discharge collection assemblies 80 and 110 may be made of any number of materials so long as they suit the particular application to which the equipment will be placed. In other words, the particular materials of which the components are made of is deemed to be a matter of choice based upon economics, availability and the particular manufacturing process utilized.

Various prototypes of the vacuum tool 10 have been made primarily of polymeric piping material, such as polyvinyl chloride (PVC) Schedule 40 plumbing pipe and fittings. Such material is suitable for handling non-corrosive material such as normal dust, dirt, most waste water and the like. The piping and fittings may be threaded in order to allow them to be screwed together or may be joined with any of the suitable adhesives known in the plumbing trade.

OPERATION AND USE

The operation and use of the vacuum-producing apparatus 10 of the present invention will now be further explained along with further details of the aforementioned prototype. The particular length and width of the individual components is not believed significant to the broader aspects of the present invention, but appears to be important with respect to achieving efficient or optimized operation. This is best explained by way of reference to the particular embodiment of my invention illustrated in FIGS. 1–4. In my prototypes of this embodiment, supply line 64, gate valve 66 and nipple 68 are nominally one-half inch ID size and feed a correspondingly sized large port 54 in the bushing 52. The inner diameter of the chambers 26 and 28 of body portions 22 and 24 is nominally 1.25 inches. The extension pipe 60 extending from the small port 56 is a 0.125 inner diameter metal pipe approximately 5 inches in length. It has been found that this length of extension pipe 60 introduces high velocity pressurized air at a distance (slightly more than one inch) sufficiently past the suction inlet to form a large negative pressure area adjacent to the suction inlet for efficient operation. Shortening the length of the extension pipe 60 reduces performance, while lengthening it does not significantly affect performance. The length 44 of the second body portion 24 in the prototype is preferably about 24 inches. Lengths significantly shorter have been found to reduce the capacity and suction power of the vacuum tool 10. However, lengthening the second body portion 24 beyond 24 inches did not improve performance. For the foregoing dimensions, it has been found that the system will operate efficiently on a steady basis at about 110 to 120 psi air pressure, although higher pressures such as 180 psi air supply may be used if desired. The air pressure may be reduced to as low as 50 psi, with a corresponding reduction in capacity and suction power although at such lower pressures it is believed desirable to reduce the diameter of chamber 14 somewhat. At 110 to 120 psi operating pressures, sufficient suction has been provided along the flexible hose 76 having a length of up to 6 feet (or more) to pick up debris and liquids very quickly.

In my prototypes, the flexible discharge hose 74 generally has been from 15 feet long to up to 50 or 60 feet long. Below 15 feet, a pressure build-up was observed when the vacuum-producing apparatus was in continuous use, due to an apparent limitation in the amount of air which could be exhausted through the particular filter bag 102 and fine mesh screen assembly 104 being used. This back pressure may be avoided by using a coarser filter, or by providing more filter area such as adding additional openings in the cover, each with its own filter bag 102 and assembly 104. Alternatively, a plurality of interconnected drums 90 could be used, each having a filter assembly.

My new vacuum tool 10 and discharge collection assembly 80 (or 110) are believed to be particularly suitable for heavy-duty applications such as vacuuming up debris and liquids in truck tires stored in an out-of-doors location while awaiting recapping and the rubber chunks, shavings, grit and smoke produced when grinding down truck tires for recapping purposes, vacuuming up broken auto glass and oil in auto repair shops, vacuuming up light metal shavings found in the machine tool industry, and the like. The present invention can also be scaled up or down in size, and the dimensions of various components reworked to operate at different pressures. For example, the inner diameter of the extension pipe 60 can be made larger than in the prototype, for example it may be made about one-tenth, one-fifth or even one-third the size of the discharge outlet 20 and the suction inlet 18.

Experiments have shown that the air-powered vacuum-producing apparatus of the present invention provides a substantial increase in the capacity and suction power in comparison to conventional air-powered vacuum-producing tools relative to the amount of compressed air per unit time required for operation. The increased efficiency and suction power of my vacuum-producing apparatus is believed in part to be due to the use of a high pressure inlet 16 which is substantially smaller than the cross-sectional of the chamber 14, and to positioning the inlet 16 downstream from the suction inlet 18. These features, in combination with a second body portion 26 having an average length 44 sufficiently greater than its average width 44, appear to be largely responsible for the efficiency of my invention. My experiments have also shown that the vacuum tool 10, especially when used in combination with a discharge collection assembly, such as assembly 80 or 110, is remarkably quiet in operation, especially when compared to shop vacuum units driven by an electric motor of comparable or even smaller capacity and suction power.

The presently preferred embodiments of the present invention described herein are intended to be exemplary only, and should not be used to limit the scope of the invention. A number of other configurations and variations of my vacuum-producing apparatus will be readily apparent to those skilled in the art. For example, the body 12 may be designed and manufactured as a unitary construction. A closed wall or interior end surface of first body portion 22 through which the extension pipe 60 extends may be substituted for the bushing 52 used to close the opening of the first chamber portion 36. Also, the vacuum tool 10 and discharge collection assemblies may be made of materials capable of withstanding debris to be collected considerably above room temperature, corrosive liquids, and/or abrasive materials if desired. For example, the tool 10 may be made of stainless steel or synthetic materials resistant to many alkali or acid substances. Accordingly, the scope of the present invention is meant to be limited only by the following claims.

I claim:

1. An improved vacuum-producing apparatus of the type powered by a stream of pressurized gaseous fluid and including a body having a chamber, a first inlet for allowing said stream of pressurized fluid to flow into said chamber, a discharge outlet for allowing said fluid to flow out of said chamber, and a second inlet in fluid communication with said chamber and arranged with respect to said first inlet and said outlet to enable a vacuum to be produced at said second inlet when said stream of pressurized fluid is flowing in said chamber, the improvement comprising in combination:

said second inlet being located relative to said first inlet and said outlet such that when said stream of pressurized fluid flows into said chamber, said stream is flowing generally away from said second inlet, said body having first and second connected body portions respectively having first and second interconnected substantially cylindrical chamber portions arranged along a common longitudinal axis which form said chamber, said first body portion including said second inlet, said second body portion including said outlet, and said first inlet opening into said second chamber portion, the average size of the chamber in cross-section transverse to the direction of the flow of pressurized fluid, the size of said outlet and the size of said second inlet each being at least three times larger in area than the size of said first inlet, and said second chamber portion having an average length which is at least about ten times its average width, said first body portion including first and second openings at opposite ends of the first chamber portion, and a hollow segment provided with a substantially cylindrical bore that is arranged at an angle to and intersects the first substantially cylindrical chamber portion, said second opening being in direct fluid communication with said second chamber portion, and said bore having a first end which is spaced from the intersection of the bore and the first chamber and which constitutes said second inlet, and the apparatus further including a bushing sealingly engaged in the first opening of said first body portion, and conduit means disposed at least partially within said chamber for providing said pressurized fluid through said bushing to said first inlet, said conduit means including an elongated hollow member having first and second ends and an average inner diameter which is at least five times smaller in area than said average size of said chamber, said hollow member being supported at the first end thereof by said bushing and extending through said first chamber portion and into said second chamber portion such that the second end thereof forms said first inlet, with the hollow member being offset from the common longitudinal axis of the first and second chamber portions in a direction which provides greater clearance for matter entering said first chamber portion through said bore.

* * * * *